United States Patent [19]

Nolan, Jr. et al.

[11] 3,953,322

[45] Apr. 27, 1976

[54] NON-CATALYTIC PROCESS FOR TREATING NAPHTHA CONTAINING OLEFINICALLY UNSATURATED COMPONENTS

[75] Inventors: John T. Nolan, Jr., Wappingers Falls; Raymond F. Wilson, Fishkill, both of N.Y.

[73] Assignee: Texaco Inc., New York, N.Y.

[22] Filed: July 8, 1974

[21] Appl. No.: 486,532

[52] U.S. Cl. ..... 208/255; 208/144

[51] Int. Cl.[2] ..... C10G 31/08

[58] Field of Search ..... 208/255, 144, 49; 260/667, 683.9, 683.1

[56] References Cited

UNITED STATES PATENTS

| | | | |
|---|---|---|---|
| 2,145,900 | 2/1939 | Sullivan et al. | 260/683.1 |
| 2,206,376 | 7/1940 | Cornelis-Vlugter | 260/683.9 |
| 2,500,159 | 3/1950 | Doherty et al. | 260/683.1 |
| 3,114,698 | 12/1963 | Viles | 208/144 |
| 3,415,898 | 12/1968 | Walker | 260/683.9 |

*Primary Examiner*—Delbert E. Gantz
*Assistant Examiner*—G. J. Crasanakis
*Attorney, Agent, or Firm*—Thomas H. Whaley; Carl G. Ries; Carl G. Seutter

[57] ABSTRACT

A naphtha is treated by heating in the presence of water, hydrogenating, and extracting desired aromatic components.

13 Claims, 1 Drawing Figure

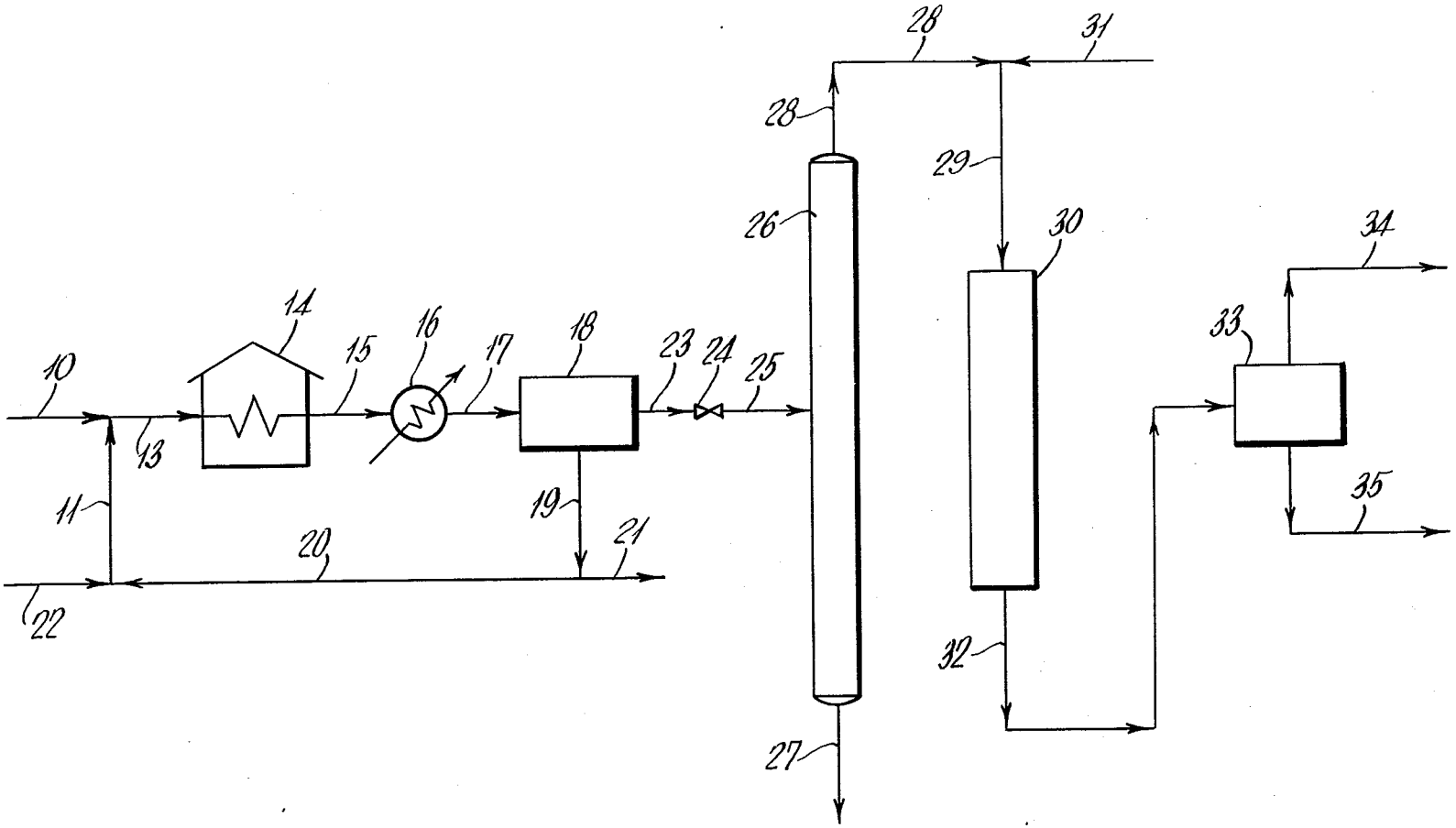
10
11
12
13
14
15
16
17
18
19
20
21
22
23
24
25
26
27
28
29
30
31
32
33
34
35

NON-CATALYTIC PROCESS FOR TREATING NAPHTHA CONTAINING OLEFINICALLY UNSATURATED COMPONENTS

BACKGROUND OF THE INVENTION

This invention relates to treating of naphtha to prepare aromatic hydrocarbons. More particularly it relates to a process for treating a pyrolysis naphtha.

As is well known to those skilled in the art, the shortage of gasoline has resulted in the need to seek greater yields of gasoline from existing stocks and/or the need to upgrade various feedstocks which have a high content of high octane components. Typical of such components are various pyrolysis naphtha streams including those recovered as by-products from thermal cracking of various charge materials including paraffin charge stocks. A commonly available pyrolysis naphtha is the steam cracked naphtha derived as a byproduct of the production of ethylene by thermal steam cracking of naphtha charge.

Pyrolysis (including thermally steam cracked) naphtha, commonly referred to as dripolene, includes the liquid byproducts of thermal steam cracking and contains 80%–90% of 5–8 carbon hydrocarbons plus 10%–20% of hydrocarbons having at least 9 carbon atoms. Generally neither fraction is passed to the gasoline pool without further treatment since they contain gums (or more accurately components which form gums during heat treatment or distillation). Typically dripolene may contain such materials in amount of 0.1%–0.5%.

These gum forming materials include a wide variety of hydrocarbons generally containing olefinic double bonds. Such components may include alkyl aromatics (e.g. styrenes), fused ring compounds (e.g. indenes), and diolefins. Most of these components may be olefins or diolefins.

These ingredients contribute to the foul odors, low volatilities, poor stability, low octane values, high gum content, etc. attributed to dripolenes.

Prior art techniques have attempted to convert dripolene or dripolene derived compositions to useful products which are free of the disadvantages derived from the noted compositions.

It is an object of this invention to provide a process for treating pyrolysis naphthas, such as dripolenes. Other objects will be apparent to those skilled in the art.

STATEMENT OF THE INVENTION

In accordance with certain of its aspects, the process of this invention for treating a pyrolysis naphtha containing olefinically unsaturated components may comprise heating said pyrolysis naphtha in the presence of water under pressure, thereby polymerizing said olefinically unsaturated components and forming a treated naphtha; and recovering said treated naphtha.

DESCRIPTION OF THE INVENTION

The charge which may be treated by the process of this invention may typically include hydrocarbons having at least about 5 carbon atoms, and typically about 5–15 carbon atoms. The charge is particularly characterized however in that it contains a substantial proportion of olefinically unsaturated hydrocarbons; these components may oligomerize or polymerize during heating or distillation to form gums.

The charge stock with which this invention may commonly find its greatest applicability is commonly referred to as a steam cracked or pyrolysis naphtha — alternatively called dripolene — which represents the liquid recovered from the effluent of a pyrolysis or thermal steam cracking operation in which naphtha has been treated to prepare olefins, typically ethylene.

This charge stock may contain 70%–90%, preferably 80%–90%, say 85% of hydrocarbons containing 5–8 carbon atoms and 10%–30%, preferably 10%–20%, say 15% of hydrocarbons having at least 9 carbon atoms. It is a feature of these charge stocks that they contain at least 5% and typically 5%–20% of olefinically unsaturated hydrocarbons.

Although the particular amount and nature of these undesirable olefinically unsaturated materials may vary depending on the charge stock, it may be found to contain dicyclopentadienes, dienes (particularly conjugated dienes), and oligomers or polymers of these materials and others.

In practice of the process of this invention, 100 parts of charge pyrolysis naphtha containing olefinically unsaturated components may be heated in the presence of water. Typically the naphtha and water may be heated to 600°F–750°F, preferably 625°–725°F, say 700°F at 0–4000 psig, preferably 10 – 3800 psig, say 3400 psig. The naphtha charge may be admitted at LHSV of 0.1–5.0, preferably 0.1–4, say 2.5; and the water may be admitted at LHSV of 0.1–5.0, preferably 0.1–4.0, say 2.5. (LHSV is based on tube volume). This corresponds to a water content of 20–200 parts, preferably 50–150 parts, say 100 parts per 100 parts of charge hydrocarbon. The preferred time of reaction may be 0.2–10 hours, preferably 0.2–8 hours, say 0.4 hours.

Although under certain conditions, the reaction may be carried on outside of these ranges, it will be noted for example that if the temperature is at or below the lower limit of about 600°F, the degree of improvement may be less. If the temperature is at or above the upper limit of about 750°F, then the treated naphtha may contain a coke-like material in amount up to 18% or more. For these reasons, the temperature is preferably maintained in the preferred range of 625°F–725°F, say 700°F.

It will be apparent to those skilled in the art however that satisfactory results may be attained by operating below the lower end of the preferred temperature range of increasing the time. Similarly, it may be possible to achieve desired results above the upper end of the preferred temperature range by decreasing the time.

Preferably treating is carried out in a tubular heater, commonly referred to as an oil heater. As the charge and water pass through the tubular heater-reactor, the olefinically unsaturated components may polymerize to form higher boiling components. Effluent is withdrawn from the tubular heater and condensed. The effluent and the charge streams may be compared as follows:

TABLE

| Property | Charge | | Product | |
|---|---|---|---|---|
| | Broad | Typical | Broad | Typical |
| API | 25–45 | 34.5 | 22–40 | 27.2 |
| Diene No. | 0.5–20 | 5.6 | 0.1–10 | 1.8 |
| Bromine No. | 10–100 | 79 | 5–35 | 15.4 |
| C-5 to C-8, vol % | 50–100 | 85 | 70–100 | 80 |

TABLE-continued

| Property | Charge | | Product | |
|---|---|---|---|---|
| | Broad | Typical | Broad | Typical |
| C-9 plus, vol % | 0–50 | 15 | 0–30 | 20 |

It will be apparent from the above table that the pretreatment of charge has lowered the content of olefinic (including diolefinic) gum precursors. The Bromine number typically drops from its initial value of 10–100, say 79 to a final value of 5–35, say 15.4. The diene number typically drops from its initial value of 0.5–20, say 5.6 to a final value of 0.1–10, say 1.8.

Bromine number is determined by ASTM Method D-1159.

Diene number is determined by the procedure set forth by H. Grosse Oetringhaus in Petroleum Z., Volume 35 (31) pages 567–573 (1939).

During preheating, a substantial portion of the olefinic components may be oligomerized or polymerized to form higher boiling components.

In practice of the process of this invention, the condensate effluent from pretreating with water may be separated to yield 20–200 parts, preferably 50–150 parts, say 100 parts of water per 100 parts of hydrocarbon layer. Preferably the water layer may be recycled, at least in part, to the pretreating reaction. A portion of the water may be drawn off; and an aliquot of fresh make-up water may be added.

In the preferred embodiment of the process of this invention, condensation of the effluent from the tubular heater and separation of the condensed water may be carried out at substantially the pressure of operation during the pretreating operation.

The pretreated naphtha is passed to a fractionation operation wherein polymers (formed from the olefins in the original charge stream) may be removed. Depending on the particular charge material being treated and its content of olefins (now at least partially polymerized), fractionation may be carried out in a flash drum or in a bubble tower.

Preferably at least a portion of the C-9 and heavier fraction is removed with the bottoms.

Bottoms from the fractionation operation may be 2–30 parts, preferably 5–20 parts, say 10 parts of product having the following composition:

TABLE

| Component | Broad | Typical |
|---|---|---|
| Lighter than C-9 fraction olefins | 0.5–25 | 2 |
| C-9 plus fraction olefin polymer | 3–25 | 8 |

Overhead from the fractionation operation, may be 70-98 parts, preferably 80-95 parts, say 90 parts of the following:

TABLE

| Property | Broad | Typical |
|---|---|---|
| API | 25–50 | 30 |
| Diene No. | 0.1–10 | 1.5 |
| Bromine No. | 3–30 | 14 |
| C-5 to C-8 | 80–100 | 85 |
| C-9 plus | 0–20 | 5 |

The pretreated steam cracked or pyrolysis naphtha, now containing say about 18 % of the olefins contained in the charge steam cracked or pyrolysis naphtha is passed to a hydrogenation operation. Hydrogenation is preferably carried out in the presence of catalyst at hydrofining conditions. In the preferred embodiment, catalytic hydrogenation may be carried out at 400°–700°F, preferably 500°–700°F, say 600°F at pressure of 200–2000 psig, preferably 300–1000, say 750 psig. Hydrogen is admitted at a rate of 200–3000, preferably 300–2500, say 1500 SCFB. Charge is admitted at a space velocity LHSV of 0.1–5, preferably 0.1–4, say 2.

Catalytic hydrogenation may be carried out in the presence of a hydrogenation catalyst, typically a supported catalyst containing a Group VIII metal optionally containing a Group VI B metal on a support. The Group VIII metal may be a noble metal such as ruthenium Ru, rhodium Rh, palladium Pd, rhenium Re, osmium Os, and iridium Ir or a non-noble metal such as cobalt Co, nickel Ni, or less preferably iron Fe. When the Group VIII metal is the preferred cobalt or nickel, there may preferably be present a Group VI B metal. The preferred catalysts include nickel-molybdenum or cobalt-molybdenum on a support. Typical supports may include alumina, silica-alumina, bauxite, etc. A typical catalyst contains 2–5% CoO plus 8–15% $MoO_3$ on gamma alumina.

Effluent from hydrofining may be characterized as follows:

TABLE

| Property | Hydrofining Product | |
|---|---|---|
| | Broad | Typical |
| API | 20–50 | 26 |
| Diene No. | 0.1–5 | 0.7 |
| Bromine No. | 2–20 | 3 |
| C-5 to C-8 | 70–100 | 83 |
| C-9 plus | 0–30 | 5 |

It will be noted from the above table that the olefin content of the hydrofined naphtha has been reduced to about 4% of the charge dripolene or thermally steam cracked naphtha.

It is a particular feature of the process of this invention that hydrofining may be carried out for extended periods of time at high yields; the catalyst will commonly be found to be usable over an extended life period. The ability to operate a catalytic hydrogenation operation for longer periods of time between regenerations represents a substantial advantage of the process of this invention.

The hydrogenated naphtha in amount of 70–98 parts, preferably 80–95 parts, say 83 parts may be passed to each extraction operation, typically a Udex operation wherein treatment may permit recovery of 40–70 parts, preferably 50–65 parts, say 60 parts of aromatics suitable for inclusion in the gasoline pool and 0–55 parts, preferably 15–45 parts, say 23 parts of paraffinics.

It will be apparent that 45%–70%, preferably 50%–65%, say 60 % of the charge steam cracked naphtha is recovered as desired aromatic product.

BRIEF DESCRIPTION OF DRAWING

The drawing schematically shows a process flow sheet according to which one embodiment of the process may be carried out.

DESCRIPTION OF PREFERRED EMBODIMENTS

Practice of the process of this invention will be apparent to those skilled in the art from inspection of the following wherein, as elsewhere in this specification, all parts are parts by weight unless otherwise stated.

EXAMPLES I–II

In this series of tests, a pyrolysis naphtha (dripolene) was charged. The charge had an API gravity of 34.5, a Bromine number of 79, and a Diene number of 5.6.

In Example I, 300g of charge naphtha and 100g of water were added to a 1600 ml batch rocking autoclave. The system was maintained at 700°F and 3400 psig for 1 hour.

In Example II, 500g of charge naphtha and 200g of water were added to the reactor. The system was maintained at 700°F and 3400 psig for 10 hours.

At the end of the noted times, the autoclave was cooled and depressurized and the pretreated naphtha was separated from the water. The properties were as follows:

TABLE

| Property | Charge | Example I | Example II |
|---|---|---|---|
| API Gravity | 34.5 | 26.3 | 27.2 |
| Bromine No. | 79 | 28.0 | 15.4 |
| Diene No. | 5.6 | 2.4 | 1.8 |

From this table, it will be apparent that the olefin content (as measured by the Bromine number) was decreased, after one hour treatment to about one-third of that of the charge and after ten hours to about 20% of that of the charge. Similarly the diolefin content (as measured by the Diene Number) is decreased after one hour to less than half of the charge and, after 10 hours, to about one-third that of the charge.

EXAMPLES III–IV

In each of the Examples in this series of control examples, the procedure of Example I was duplicated except that the temperatures of operation were 750°F in Example III and 800°F in Example IV.

In Example III, 18% of a coke like material was observed (25% in Example IV). These results showed that these temperatures were too high to provide the selective polymerization necessary to pretreat the charge stock.

EXAMPLES V–VI

In each of the examples in this series, the procedure of Example I was duplicated except that the temperature was 500°F in Example V and 600°F in Example VI.

TABLE

| Property | Charge | Example I | Example V | Example VI |
|---|---|---|---|---|
| API | 34.5 | 26.3 | 27.6 | 26.3 |
| Diene No. | 5.6 | 2.4 | 3.7 | 3.0 |
| Bromine No. | 79 | 28.0 | 59.3 | 43.9 |

From the above table, it will be apparent that at below, 600°F (the lower limit of the preferred temperature range), the results achieved eg in Examples V–VI may be satisfactory although they are not as good as those (Example I) within the preferred range.

EXAMPLE VII

In this Example, 500g of the charge pyrolysis naphtha of Example I was treated with 200g of water at 700°F and 3400 psig for 10 hours. Product pretreated naphtha was separated to give a water portion and a hydrocarbon portion. The latter (472g) was hydrofined at 600°F and 900 psig of hydrogen for 10 hours over 50g of Cyanamid Aero catalyst HDS-3A. The catalyst is an alumina-supported catalyst (1/16 each extrudate) which in this example had a density of 0.772, a crush strength of 13 pounds, a sulfur content of 0.10–0.29%, a pore volume of 0.49–0.54 cc/g, and a surface area of 192–215 $m^2/g$. It contained 13.6% Mo, 1.95–2.09% nickel, 0.088% iron, and 0.38% vanadium.

Liquid hydrofined product represented 92% (460g) of the fresh charge to the pretreating step. It had a Bromine number of 3.0, a Diene Number of 0.7, and a gravity of 26.2 API.

The result of this example clearly shows that the combination of high temperature water pretreatment followed by catalytic hydrogenation produces a product naphtha of low olefin and diolefin content which is suitable for inclusion in the feed to an aromatics extraction plant.

EXAMPLES VIII–IX–X

In this series of Examples, three samples (300g each) of the charge pyrolysis naphtha of Example I were pretreated as follows:

Example VIII — As in Example I with water at 700°F for 1 hour;

Example IX — As in Example I (but without water) at 700°F for 1 hour;

Example X — No pretreatment.

Each of these three samples was hydrofined using hydrogen at 600°F and 900 psig over 50g of Cyanamid Aero HDS-3A catalyst for 1 hour. The so treated hydrocarbons had the following characteristics:

TABLE

| Property | Example VIII | Example IX | Example X |
|---|---|---|---|
| API | 24.8 | 26.9 | 26.6 |
| Diene No. | 1.2 | (Too Dark — unsuitable) | |
| Bromine No. | 11.4 | 13.0 | 22.0 |

From these data, it is apparent that the process of this invention (Example VIII) gives significant improvement in the olefin (and diolefin) content of a dripolene while control processes do not permit attainment of such improvements.

EXAMPLE XI

Practice of the process of this invention will be more apparent to those skilled in the art from inspection of the attached drawing which schematically shows a process flow sheet according to which the process of this invention may be carried out. It will be apparent that this drawing is schematic and does not show details of various equipment including pumps, storage vessels, heat exchangers, etc. which may be employed in a plant in which this process would be carried out.

100 Parts of charge thermal steam cracked pyrolysis naphtha (dripolene) are admitted through line 10 to-gether with 100 parts of water admitted through line 11. The combined stream in line 13 is passed to tubular furnace 14 wherein the stream is heated to 700°F and 3400 psig. The naphtha charge corresponds to an LHSV of 2.5 and the water charge corresponds to an LHSV of 2.5. Effective residence time of the naphtha plus water in pretreating operation is about 0.4 hours.

Pretreated naphtha and water are withdrawn through line 15, condensed in heat exchanger 16 and passed through line 17 to separator 18 wherein the temperature is about 70°F at 3400 psig. 100 Parts of water are separated, withdrawn through line 19 and passed through line 20 to water charge line 11. Optionally a portion of the water in line 19 may be withdrawn through line 21; and make-up fresh water as needed may be admitted through line 22.

100 Parts of pretreated naphtha is withdrawn through line 23 and flashed through flash valve 24 and line 25 into polymer separation operation 26 which in this embodiment may be a bubble tower. 2 Parts of polymer and 8 Parts of C-9 plus hydrocarbon are withdrawn through line 27.

Overhead in line 28 includes 90 parts of a C-5 to C-8 fraction, containing some C-9. This stream, recovered at 100°F and 20 psig, is combined with hydrogen from line 31 and the mixture passed through line 29 to hydrogenation operation 30. Charge is admitted at 600°F and 750 psig. Hydrogen is admitted at a rate of 1500 SCFB; and a hydrocarbon charge enters at a space velocity LHSV of 2. Catalyst is 3.5% cobalt oxide and 10% molybdenum oxide on gamma alumina.

Effluent from hydrofining operation in line 32 includes 83 parts of hydrofined naphtha containing substantially no olefins; this stream is passed to Udex extraction operation 33 from which 60 parts of aromatic are recovered in line 34; and 23 parts of paraffins and olefins, are recovered through line 35.

Although this invention has been illustrated by reference to specific embodiments, it will be apparent to those skilled in the art that various changes and modifications may be made which clearly fall within the scope of this invention.

We claim:

1. The process for treating a pyrolysis naphtha containing olefinically unsaturated components which comprises:

heating said pyrolysis naphtha in a non-catalytic reaction in the presence of water in amount of 20–200 parts by weight of water per 100 parts by weight of said naphtha, under pressure thereby polymerizing said olefinically unsaturated components, and forming a treated naphtha; and recovering said treated naphtha.

2. The process for treating a pyrolysis naphtha containing olefinically unsaturated components as claimed in claim 1 wherein said heating is carried out at 600°F–750°F.

3. The process for treating a pyrolysis naphtha containing olefinically unsaturated components as claimed in claim 1 wherein said heating is carried out at 625°F–725°F.

4. The process for treating a pyrolysis naphtha containing olefinically unsaturated components as claimed in claim 1 wherein said heating is carried out at 0–4000 psig.

5. The process for treating a pyrolysis naphtha containing olefinically unsaturated components as claimed in claim 1 wherein said heating is carried out at 10–3300 psig.

6. The process for treating a pyrolysis naphtha containing olefinically unsaturated components as claimed in claim 1 wherein said heating is carried out at autogenous pressure.

7. The process for treating a pyrolysis naphtha containing olefinically unsaturated components which comprises:

heating said pyrolysis naphtha in a non-catalytic reaction in the presence of water, in amount of 20–200 parts by weight of water per 100 parts by weight of said naphtha, to 600°F–750°F at 10–3800 psig thereby polymerizing said olefinically unsaturated components and forming a treated naphtha; and recovering said treated naphtha.

8. The process for treating a pyrolysis naphtha containing olefinically unsaturated components which comprises:

heating said pyrolysis naphtha in a non-catalytic reaction in the presence of water, in amount of 20–200 parts by weight of water per 100 parts by weight of said naphtha, under pressure thereby polymerizing said olefinically unsaturated components and forming a treated naphtha;

recovering said treated naphtha;

hydrogenating said treated naphtha; and recovering said hydrogenated treated naphtha.

9. The process for treating a pyrolysis naphtha containing olefinically unsaturated components and aromatic components which comprises heating said pyrolysis naphtha in a non-catalytic reactions in the presence of water, in amount of 20–200 parts by weight of water per 100 parts by weight of said naphtha, under pressure thereby polymerizing said olefinically unsaturated components and forming a treated naphtha;

recovering said treated naphtha;

hydrogenating said treated naphtha thereby forming a hydrogenated treated naphtha containing aromatic components; and recovering said naphtha containing said aromatic components.

10. The process for treating a pyrolysis naphtha containing olefinically unsaturated components and aromatic components which comprises heating said pyrolysis naphtha in a non-catalytic reactions in the presence of water, in amount of 20–200 parts by weight of water per 100 parts by weight of said naphtha, at 625°F–725°F and 10-3800 psig thereby polymerizing said olefinically unsaturated components and forming a treated naphtha;

recovering said treated naphtha;

hydrogenating said recovered treated naphtha at 500°F–700°F and 300–1000 psig in the presence of hydrogenation catalyst thereby forming hydrogenated treated naphtha containing aromatic components; and extracting said aromatic components from said hydrogenated treated naphtha.

11. The process for treating a pyrolysis naphtha as claimed in claim 10 wherein said pyrolysis naphtha is a steam cracked naphtha.

12. The process for treating a pyrolysis naphtha containing olefinically unsaturated components and aromatic components which comprises heating a mixture consisting essentially of said pyrolysis naphtha and water, in amount of 20–200 parts by weight of water per 100 parts by weight of said naphtha, under non-catalytic polymerization conditions thereby polymerizing said olefinically unsaturated components and forming a treated naphtha; and recovering said treated naphtha containing said aromatic components.

13. The process for treating a pyrolysis naphtha containing olefinically unsaturated components as claimed in claim 12 wherein said recovered treated naphtha is hydrogenated at hydrogenating conditions in the presence of hydrogenation catalyst thereby forming a hydrogenated treated naphtha containing aromatic components.

* * * * *